US006146048A

United States Patent [19]

Stibolt

[11] Patent Number: 6,146,048

[45] Date of Patent: Nov. 14, 2000

[54] CONNECTOR FOR TWO DRYWALL CORNER FINISHING DEVICES

[76] Inventor: Paul E. Stibolt, 21413 Main St., Matteson, Ill. 60443

[21] Appl. No.: 09/078,367

[22] Filed: May 13, 1998

[51] Int. Cl.[7] ..... F16B 2/02; F16B 7/04

[52] U.S. Cl. ..... 403/313; 24/462; 52/255; 52/287.1; 52/585.1; 52/656.9; 52/745.1; 403/310

[58] Field of Search ..... 24/458, 459, 460, 24/462; 52/255, 287.1, 288.1, 417, 585.1, 586.1, 656.9, 745.1, 745.13; 403/292, 302, 309, 310, 311, 313

[56] References Cited

U.S. PATENT DOCUMENTS

| | | | |
|---|---|---|---|
| 1,051,427 | 1/1913 | McCluskey . | |
| 2,833,575 | 5/1958 | Haller et al. | 403/313 |
| 2,835,118 | 5/1958 | Varner . | |
| 2,863,185 | 12/1958 | Riedi . | |
| 2,875,866 | 3/1959 | Hess | 52/586.1 X |
| 3,502,359 | 3/1970 | Lucci . | |
| 3,671,062 | 6/1972 | Ashworth | 403/292 |
| 3,782,054 | 1/1974 | Goss, Jr. . | |
| 4,570,408 | 2/1986 | Frascaroli et al. . | |
| 4,979,345 | 12/1990 | Celsi | 52/586.1 X |
| 5,022,777 | 6/1991 | Kolvites . | |
| 5,048,997 | 9/1991 | Peterson . | |
| 5,209,599 | 5/1993 | Kronenberg . | |
| 5,459,969 | 10/1995 | Stibolt et al. . | |
| 5,531,050 | 7/1996 | Stibolt et al. . | |
| 5,531,051 | 7/1996 | Chenier, Jr. et al. | 52/255 |
| 5,603,582 | 2/1997 | Loh . | |
| 5,740,642 | 4/1998 | Koenig, Jr. et al. | 52/255 |
| 5,813,179 | 9/1998 | Koenig, Jr. et al. | 52/255 |

FOREIGN PATENT DOCUMENTS

| | | |
|---|---|---|
| 2104993 | 3/1983 | United Kingdom . |

*Primary Examiner*—Carl D. Friedman
*Assistant Examiner*—Kevin D. Wilkens
*Attorney, Agent, or Firm*—Ladas & Parry

[57] ABSTRACT

A connector and method for connecting two drywall corner finishing devices. The connector connects and/or aligns the two drywall corner finishing devices positioned end to end by being inserted into corresponding openings located in the profile of the drywall corner finishing devices. The side members of the connector are pinched in, reducing the size and shape of the cross-section of the connector so as to fit within the corresponding openings. When released the side members deflect back pressing out against the sidewall of the openings.

16 Claims, 1 Drawing Sheet

CONNECTOR FOR TWO DRYWALL CORNER FINISHING DEVICES

BACKGROUND OF THE INVENTION

The present invention relates generally to a connector for connecting and/or aligning multiple devices together, and more specifically to a connector for connecting together two drywall corner finishing devices.

Building materials are often manufactured and sold having predetermined standard lengths. Sometimes there can be several standard lengths. For example certain types of lumber or wood are sold in two foot increments above a certain minimum standard length up to a certain maximum standard length.

If during a construction job, like building a house, a non-standard length piece of wood is required, the builder will often start with a piece of wood larger than needed and cut it to the appropriate size. Occasionally it may be necessary to piece together multiple pieces to form the desired length, especially when the desired length is longer than the largest standard length. The same is true for other types of building materials.

For some types of building materials, connecting together multiple pieces may require special care to insure proper alignment is maintained. One such type of building material which may require special care, when connecting together or adjoining multiple pieces, is a drywall corner finishing device. Examples of drywall corner finishing devices are disclosed in U.S. Pat. No. 5,459,969 and U.S. Pat. No. 5,531,050, the disclosures of which are incorporated herein by reference.

One of the features of the drywall corner finishing devices is the provision for forming an internal or an external corner having a straight and smooth finish. However it is rarely possible to rely upon the underlying framing for insuring that adjacent drywall corner finishing devices would line up consistently straight. This is because of inherent differences in the sizes of the wood used for framing resulting from such things as warping of the wood, and inconsistent building practices. Therefore where it is required to piece together multiple adjacent drywall corner finishing devices, it would be beneficial to provide for a connector which will connect multiple drywall corner finishing devices together, for providing connection and alignment of adjacent drywall corner finishing devices, for maintaining a corner having a straight and smooth finish independent of the underlying framing.

SUMMARY OF THE INVENTION

According to the present invention there is provided a connector for being received in corresponding openings preferably located in the profile of multiple devices to be connected like drywall corner finishing devices. The connector comprises a cross member and a first and a second side member or leg, each flexibly coupled to and extending from opposite edges of the cross member. The cross member together with the first and second side members form a cross-section.

The first and second side members are flexibly coupled to the cross member at an angle so that, in a relaxed state, the size and shape of said cross-section prevents the ready insertion of the connector into the opening of any of the devices to be connected. A force, such as a pinching force, can be applied to the two side members, deflecting the side members with respect to the cross member, so as to alter the size and shape of the cross-section allowing for insertion of at least one end of the connector into the corresponding opening of the devices to be connected.

The connector further preferably provides for a gripping structure consisting of a curved connection between the cross member and the side members for applying a holding force against the internal surface of the sidewall of the opening at or near the vertices formed by the sidewall of the opening. The cross member and the side members, preferably curve inward away from the sidewalls, avoiding contact with the sidewall, so as to avoid applying a force to the sidewalls away from the vertices.

The connector further preferably provides for a stopping structure in the form of a slit, which allows a portion of the side wall to remain sufficiently undeflected, so as to restrict insertion of the connector beyond the slit.

By connecting the devices to be connected together via corresponding openings in the multiple devices, the features of the adjacent devices can line up with respect to one another, allowing the features to extend across multiple devices without apparent interruption, especially an internal or an external corner formed by the drywall corner finishing device.

Other objects, features and advantages of the present application will be apparent from the detailed description and drawings which follow.

DESCRIPTION OF THE PREFERRED EMBODIMENT

Figure 1:
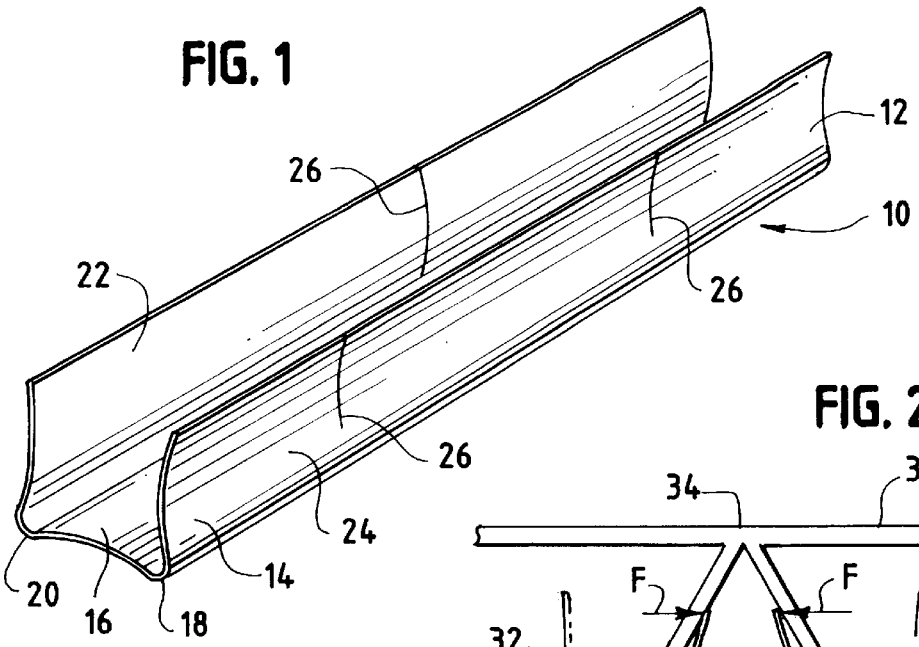
FIG. 1 is a perspective view of a connector for connecting and/or aligning multiple devices together, in accordance to the teachings of the present invention.

Referring now to the drawings in greater detail, there is illustrated in FIG. 1 a perspective view generally depicting a connector 10 for connecting and/or aligning multiple devices together. The connector has a first end 12 for inserting into a first device to be connected and a second end 14 for inserting into a second device to be connected. The connector includes a cross member 16 having opposite edges 18 and 20, and a first side member 22 and a second side member 24 flexibly coupled to and extending from opposite edges 18 and 20 of the cross member 16, forming a connector 10 having a C-shaped cross-section.

The connector 10 further includes at least one stopping structure. The stopping structure is preferably in the form of a slit 26 in one of the side members 22 and 24. In the preferred embodiment the first side member 22 includes a single stopping structure or slit 26 located approximately one half of the distance between the two ends 12 and 14 of the connector 10. The second side member 24 includes a pair of stopping structures or slits 26 located so as to trisect the second side member 24 approximately into thirds. Preferably the connector 10 would be formed as a plastic extrusion, wherein the slits 26 would be formed by making one or more cuts into at least one of the side members 22 and 24.

Figure 2:
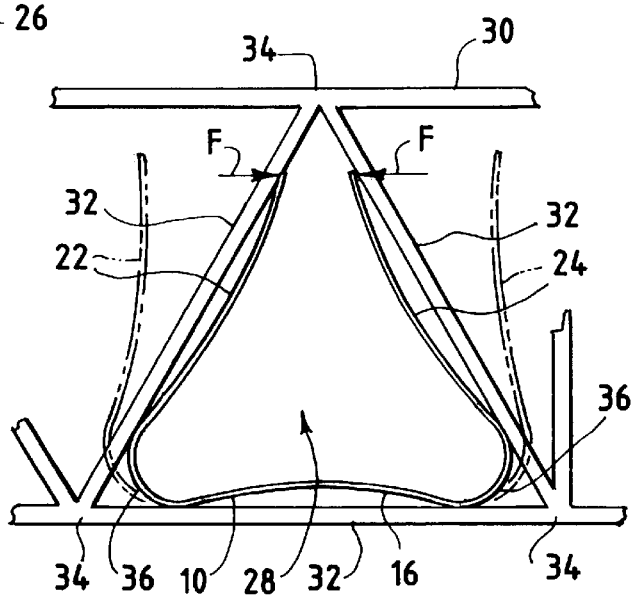
FIG. 2 is an end view of the connector, shown in FIG. 1, showing the shape of the cross section of the connector before and after inserting the connector into the opening located in the profile of the device to be connected.

FIG. 2 shows an end view of the connector 10, shown in FIG. 1, inserted into an opening 28 located in the profile of a device to be connected, in this case a drywall corner finishing device 30, a partial view of which is shown. The opening is formed by sidewalls 32 coupled together at vertices 34.

The dashed lines represent the natural undeflected shape of the side members 22 and 24 of the connector 10, as shown in FIG. 1. However in this state the C-shaped cross-section of the connector 10 is larger than the opening 28 in the profile of the drywall corner finishing device 30. In order to insert the connector 10 into the opening 28 of the drywall corner finishing device 30, a pinching force F is applied to both side members 22 and 24, causing the side members 22 and 24 to be deflected. Once deflected, the size and shape of the cross-section of the connector 10 is sized so as to allow entry into the opening 28 of the drywall corner finishing device 30.

Once inserted, the pinching force F is removed from the side members 22 and 24, resulting in the side members 22 and 24 pushing against the sidewalls of the opening 28. The connector includes a holding structure, preferably a corresponding curved connection 36 located between the cross member 16 and each of the side members 22 and 24, which makes actual contact with the sidewalls 32 of the opening 28. As the pinching force F is removed, the radius of the curved connection 36 expands, until it is prevented from further expansion by the sidewalls 32. When the curved connection 36 comes into contact with the sidewalls 32, the remaining unreleased deflection between the cross member 16 and the side member 22 and 24 produces a force, which pushes against the sidewall 32 causing a frictional force which restricts against further movement of the connector 10 within the opening 28.

The preferred embodiment further provides for a cross member 16 and side members 22 and 24, which are curved inward away from the sidewalls 32, so as to avoid contact with the sidewalls away from the vertices 34. This moves the contact points with the sidewalls 32, so as to be at or near the vertices 34. By moving the contact points to be at or near the vertices and away from the center of the sidewalls 32, the potential for deflection in the sidewalls 32 of the opening 28 is minimized. Preferably the thickness of the connector 10 will be less than the thickness of the sidewall 32 of the opening to help further minimize any sidewall distortion.

Figure 3:
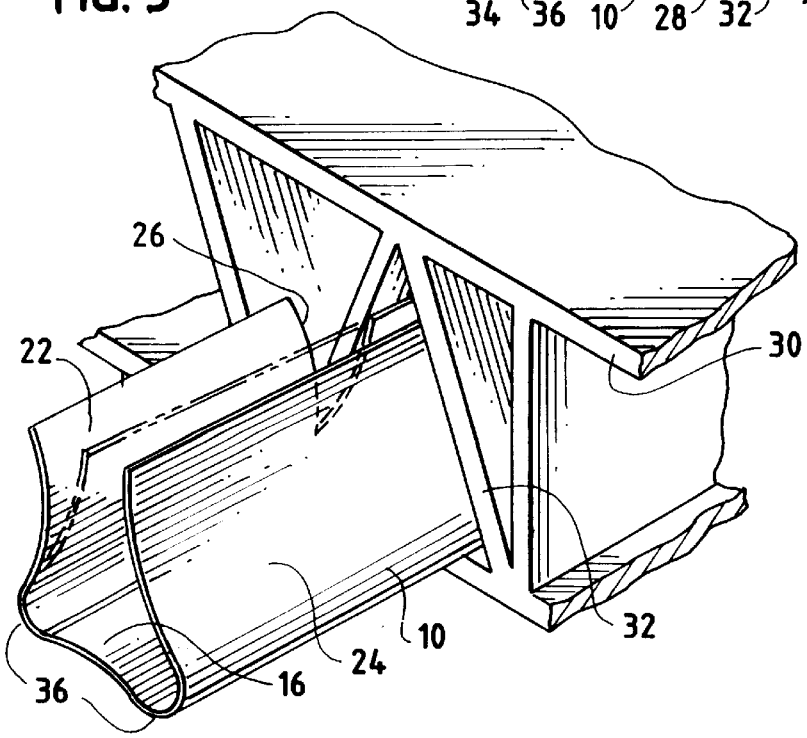
FIG. 3 is a partial perspective view of the connector, shown in FIG. 1, having a portion of the side member deflected and inserted within the opening located in the profile of the device to be connected.

FIG. 3 shows a partial perspective view of the connector 10, shown in FIG. 1, having a portion of the side member 22 deflected with respect to the cross member 16 and inserted within the opening 28 located in the profile of the device to be connected or drywall corner finishing device 30. The side member 22 includes a stopping structure or slit 26 for resisting the further insertion of the connector into the opening beyond a predetermined point.

The slit 26 isolates a portion of side member 22 from the pinching force F, used for altering the size and shape of the cross-section for allowing a portion of the connector 10 to be inserted into the opening 28. The slit 26 preferably extends for the width of the side member 22 from the edge to the curved connection 36. As the connector is inserted into the opening, the edge formed by the slit 26, corresponding to the portion of the side member 22 remaining at least partially undeflected, due to its isolation from the pinching force F, comes into contact with the front facing of the opening 28 restricting the further insertion of the connector 10.

As previously discussed in connection with FIG. 1, in the preferred embodiment, a single slit 26 is formed in one side member 22 at approximately the midpoint between the ends 12 and 14 of the connector. In the other side member 24, a pair of slits 26 are each located approximately one third of the length of the connector away from each corresponding end 12 and 14, in effect trisecting the side. Each slit 26 provides for a corresponding stop point.

By providing multiple stop points, multiple connectors 10 can more easily be used for connecting and/or aligning multiple drywall corner finishing devices 30, wherein each connector 10 is inserted a different variable amount. This allows the user to connect a second drywall corner finishing device 30, to the connectors 10 already inserted and extending from the first drywall corner finishing device 30, one connector 10 at a time.

Preferably at least two connectors 10 will be used for connecting and/or aligning adjacent multiple drywall corner finishing devices 30, one on each side of the corner formed by the drywall corner finishing device 30, in order to more accurately assist in the alignment of the corner extending across multiple finishing devices 30. In this way features of the multiple devices can be aligned and extend across multiple devices without apparent interruptions.

From the foregoing description, it will be apparent that the connector 10 of the present invention has a number of advantages, some of which have been described above and others of which are inherent in the invention. Also it will be understood that modifications can be made to the connector 10 described above without departing from the teachings of the invention.

I claim:

1. A connector having a first end and a second end for being received in corresponding openings of multiple devices to be connected, each opening having a plurality of sidewalls, each sidewall having two edges, each sidewall being coupled to another sidewall at each sidewall edge, the connector comprising:

a cross member having opposite edges and a first and a second side member, each flexibly coupled to and extending from opposite edges of said cross member at an angle for forming a cross-section, so that in a relaxed state the size and shape of said cross-section prevents the insertion of the connector into the opening of any of the devices to be connected, the two side members being adapted to be deflected with respect to the cross member when a force is applied to the side members, so as to alter the size and shape of the cross-section allowing for insertion of at least one of the first and second ends into the corresponding opening of the devices to be connected, the connector cross member and side members being inwardly curved such that the cross member and side members contact the sidewalls only proximate the sidewall edges when the connector is inserted in the opening, thereby minimizing deflection of the sidewalls due to connector insertion.

2. The connector of claim 1, wherein said side members flexibly coupled to said cross member form a C-shaped cross-section.

3. The connector of claim 1, wherein said first and second side members extend the length of the connector between the said first end and said second end.

4. The connector of claim 1, wherein the connector is adapted for being inserted into a triangular shaped opening.

5. The connector of claim 1, wherein the connector is adapted for being inserted into an opening located in the profile of the devices to be connected.

6. The connector of claim 1 wherein said connector further comprises at least one holding structure for gripping against at least one of said plurality of sidewalls.

7. The connector of claim 6, wherein the holding structure comprises a corresponding curved connection having a radius, coupled between the cross member and each of the side members for gripping near vertices formed by the sidewalls of said opening.

8. The connector of claim 1, further comprising a stopping structure for resisting the insertion of the connector into said opening beyond a predetermined point.

9. The connector of claim 8, wherein said stopping structure comprises a slit in one of the side members.

10. The connector of claim 9, wherein said slit is located approximately half the distance between the first and the second end of the connector.

11. The connector of claim 8, further comprising additional stopping structures for resisting the insertion of the connector beyond additional predetermined points.

12. The connector of claim 11, wherein said additional stopping structures comprise slits in at least one of the side members.

13. A method for connecting multiple devices together, each having corresponding openings, each opening having a plurality of sidewalls, each sidewall having opposite edges, each sidewall being coupled to another sidewall at each sidewall edge, said method comprising the steps of:

providing a connector having a first end and a second end and including two side members coupled to opposite edges of a cross member, the cross member and side members being inwardly curved such that the cross member and side members contact the sidewalls only proximate the sidewall edges when the connector is inserted in the opening, thereby minimizing deflection of the sidewalls due to connector insertion;

applying a force to the side members of the connector so as to deflect the position of the side members with respect to the cross member;

inserting the connector into the corresponding openings of the multiple devices; and removing the force from the side members.

14. The method of claim 13, wherein the step of inserting the connector into corresponding openings of the multiple devices, includes inserting the first end and a portion of the connector into the corresponding opening of one of the multiple devices, and inserting the second end and the remaining portion of the connector into the corresponding opening of another one of the multiple devices.

15. The method of claim 13, wherein at least one of the side members includes a stopping structure comprising a slit, and the force is applied to only a portion of the side member on one side of the slit.

16. The method of claim 13, wherein the force is a pinching force applied to both of the two side members.

* * * * *